United States Patent [19]

Lindemann

[11] 3,963,527

[45] June 15, 1976

[54] CHROMATIZING PROCESS AND COMPOSITION

[75] Inventor: Karl H. Lindemann, Geinsheim, Germany

[73] Assignee: Lindemann & Co. GmbH, Geinsheim, Germany

[22] Filed: Jan. 2, 1975

[21] Appl. No.: 537,915

[30] Foreign Application Priority Data

Jan. 4, 1974 Germany ..... 2400354

[52] U.S. Cl. ..... 148/6.2; 106/1; 427/437

[51] Int. Cl.[2] ..... C23F 7/26

[58] Field of Search ..... 106/1; 117/130 E, 71; 148/6.2; 204/51, 38 S

[56] References Cited

UNITED STATES PATENTS

| | | | |
|---|---|---|---|
| 3,653,953 | 4/1972 | Grant et al. | 106/1 |
| 3,816,142 | 6/1974 | Lindemann | 117/130 E X |

*Primary Examiner*—Ralph S. Kendall

*Attorney, Agent, or Firm*—Wallenstein, Spangenberg, Hattis & Strampel

[57] ABSTRACT

Zinc articles or, respectively, articles being electroplated with zinc are rapidly coated with a resistant and well adhering colored electroless chromium plating by immersing the articles in an aqueous bath containing besides known wetting agents a. a solution of 12.5 to 37.5 g/l. of sodium dichromate and 12.5 to 37.5 g/l. of sodium nitrate, said solution being adjusted to a pH value of 0.3 with nitric acid, b. 25 to 70 g./l. of formic acid and/or chloroformic acid, c. 0 to 40 ml./l. of glacial acetic acid and concentrated acetic acid respectively and/or glycolic acid, glycocoll, chloroacetic acid, trifluoro-acetic acid and, if desired d. 0 to 15 ml./l. of formaldehyde and maintaining the pH of the solution at a pH value of 1.4 to 2.7.

2 Claims, No Drawings

CHROMATIZING PROCESS AND COMPOSITION

BACKGROUND OF THE INVENTION

The invention relates to a process for chromatizing zinc articles or, respectively, articles which have been electroplated with zinc in particular from acid baths, such as sulfuric acid containing plating baths.

It is known to provide zinc or articles electroplated with zinc with a passivating chromium coating. Thus it is possible to provide zinc and zinc coatings with a black chromium layer (by the so-called black chromium electroplating process) by using electrolytes which contain about 350 g./l. of chromium trioxide $CrO_3$, 5 g./l. of barium carbonate and 5 g./l. of glacial acetic acid at high current densities of 100 to 200 amps/dm$^2$ and low temperatures of from 12°C. to 18°C. The chromium coatings obtained in this manner contain 20 to 30% of chromium oxide but the process is costly and not generally applicable. Further brightening of zinc coatings may be performed by immersing the zinc plated articles in a solution of 100 g./l. of chromium acid, 10 g./l. of sulfuric acid and 5 g./l. of nitric acid. The chromium coatings obtained by this electroless chromium plating process are of a brown color. Frequently the unterlying zinc coating is attacked by this process and it is not possible to obtain chromium coatings which are resistant to wiping and scratching and which are sufficiently adhering in particular on articles being electroplated with zinc from acid baths.

SUMMARY OF THE INVENTION

It has been found that electroless plated passivating chromium coatings of olive to brown color which are resistant and well adhering may be provided to articles which had been electroplated with zinc by applying an aqueous plating bath containing particular ingredients in a particular concentration under particular conditions such as a specified range of pH values within very short immersing periods.

It is an object of the invention to provide a chromatizing process for articles electroplated with zinc comprising immersing said articles in an acid, aqueous bath said bath containing besides known wetting agents a. a solution of 12.5 to 37.5 g./l. of sodium dichromate and 12.5 to 37.5 g./l. of sodium nitrate, said solution being adjusted to a pH value of 0.3 with nitric acid,
b. 25 g./l. to 70 g./l. of formic acid or chloroformic acid or both;
c. 0 ml./l. to 40 ml./l. of a member of the class consisting of glacial acetic acid, concentrated acetic acid, glycolic acid, glycocoll, chloroacetic acid and trifluoroacetic acid, and, optionally,
d. 0 to 15 ml./l. of formaldehyde and maintaining said bath at a pH value of from 1.4 to 2.7.

It is further object of the invention to provide a chromatizing bath for electroless plating of electroplated zinc articles and coatings, said bath containing the ingredients mentioned under (a) to (d) above and having a pH value of from 1.4 to 2.7.

A further object of the invention is to provide a chromatizing process and an electroless plating bath for zinc articles or articles electroplated with zinc said bath containing a. 15 to 35 g./l. of sodium dichromate and 15 to 35 g./l. of sodium nitrate, said solution being adjusted to a pH value of 0.3 with nitric acid, b. 25 to 40 ml./l. of a solution of formic acid having a density of 1.133 at 20°C.
c. 5 to 35 ml./l. of glacial acetic acid or glycolic acid and, if desired,
d. 5 to 12 ml./l. of formaldehyde (calculated as a solution of 100% by weight), said bath having a pH from 1.4 to 2.7.

Further objects of the invention may be taken from the following description.

DESCRIPTION OF THE INVENTION

It has been found that articles of zinc and articles electroplated with zinc, in particular from sulfuric acid containing electroplating baths may be chromatized by applying to said articles an electroless plating bath thereby carefully adjusting the pH range as mentioned above. Such adjustment may be effected by continuous pH measurement and, if desired, by the addition of fresh solutions to the exhausted bath. The process yields passivating chromium coatings of olive to brown color, having excellent resistance to cracking and wiping and adhering properties within a very short residence time in the bath. The color is mainly governed by the amount of organic acids in the electroless chromium plating bath and is reproducible. The color may be shifted to green shades by the addition of formic acid or, respectively, chloroformic acid and to olive to brown shades by the addition of acetic acid or, respectively, substituted acetic acids.

The residence time in the bath is very short and amounts to from 6 to 60 seconds at a temperature of from 15°C. to 45°C. The resulting passivating chromium layer is completely resistant against wiping and scratching in the wet state and is resistant to cracks resulting from bending the article. It is well adhering in the dry state in particular at upset zones of zinc plated articles which have been provided with a chromium layer. This is of particular importance with articles electroplated with zinc and provided with an electroless chromium layer which are bent subsequently. The residence time may even be reduced at constant bath concentration, by increasing the temperature in the range of from 25°C. to 45°C. or, at constant temperature, by increasing the concentration of the constituents in the bath.

The ratio of trivalent chromium to hexavalent chromium ions in the bath is essentially constant when applying the process and bath of the invention. This contributes to superior properties of the chromium layer as obtained according to the invention.

The invention is illustrated by the following example.

EXAMPLE 1

A solution A consisting of 450 grams of sodium dichromate and 375 grams of sodium nitrate, filled up to 4 liters with deionized water and adjusted to a pH of 0.3 with nitric acid was prepared.

Further, a solution B consisting of 6,72 grams of concentrated formic acid, filled up to 5 liters with deionized water was prepared.

Both solutions A and B were mixed together by adding 5 grams of a long-chain alkyl aryl sulfonate as wetting agent and filled up to 10 liters using deionized water.

In the electroless chromium plating bath of a pH of 1.8 thus obtained were immersed iron articles provided with an electroplated zinc coating obtained from a sulfuric acid containing electrolyte. After 5 seconds of residence time at 25°C. the articles were taken from the bath. There was obtained a finely crystalline chromium coating of olive color which was resistant against wiping and scratching in the wet state and which adhered very strongly in the dry state. The articles could be bent without peeling of the chromium layer at the place of bending.

EXAMPLE 2

In the same manner as in Example 1 an electroless chromium plating bath was prepared containing 12.5 g./l. of sodium nitrate, 12.5 g./l. of sodium dichromate, 28 g./l. of formic acid, 6 ml./l. of glacial acetic acid and 0.5 ml./l. of the wetting agent. The pH value of the bath amounted to 2.2 and the temperature to 25°C. Zinc electroplated iron articles were immersed in the bath for 35 seconds. There were obtained excellent light olive colored chromium coatings which were resistant to wiping and scratching.

EXAMPLE 3

The bath used in Example 2 was applied for 10 seconds at a bath temperature of 40°C. Similar coatings with the same superior properties were obtained.

EXAMPLE 4

As in Example 1 a bath having a pH value of 2.1 was prepared which contained 22.5 g./l. of sodium nitrate, 27 g./l. of sodium dichromate, 28 g./l. of formic acid, 20 ml./l. of glacial acetic acid, 10.5 ml./l. of formaldehyde (calculated as a solution of 100% by weight) and 0.5 ml./l. of the wetting agent. Zinc plated articles were immersed in the bath at 25°C. for 15 seconds. The chromium coatings obtained were of olive green color and were very strongly adhering in the dry state.

EXAMPLE 5

As in Example 1 a bath having a pH value of 2.2 was prepared which contained 12.5 g./l. of sodium nitrate, 12.5 g./l. of sodium dichromate, 28 g./l. of formic acid, 16 ml./l. of glacial acetic acid and 0.5 ml./l. of the wetting agent. Zinc plated articles were immersed in the bath at 25°C. for 35 seconds. The chromium coatings obtained were of dark olive-green color and were very strongly adhering in the dry state.

EXAMPLE 6

Using the bath of Example 5 zinc plated articles were chromatized at 40°C. for 10 seconds. The chromium coatings obtained were very similar with respect to color and quality.

EXAMPLE 7

As in Example 1 a bath having a pH value of 1.6 was prepared which contained 31 g./l. of sodium nitrate, 37.5g./l. of sodium dichromate, 42 g./l. of formic acid, 30 ml./l. of glycolic acid and 0.5 ml./l. of the wetting agent. Zinc plated articles were immersed in the bath at 25°C. for 15 seconds. The chromium coatings obtained were of dark olive-green color and were very strongly adhering in the dry state.

EXAMPLE 8

The bath of Example 7 was used on zinc plated articles with the exception that the glycolic acid was replaced by a mixture of 15 ml./l. of this acid and 15 ml./l. of glacial acetic acid. The pH value of the bath amounted to 1.5. There were obtained similar coatings.

EXAMPLE 9

The bath of Example 7 was used on zinc articles with the exception that the glycolic acid was replaced by 30 ml./l. of chloroacetic acid. The pH value of the bath amounted to 1.4. The coatings obtained were of dark olive-green color and had similar properties.

EXAMPLE 10

The bath of Example 7 was used on zinc plated articles with the exception that the glycolic acid was replaced by 30 ml./l. of glycocoll. The pH value of the bath amounted to 1.5. The chromium coatings obtained were of similar color and quality.

EXAMPLE 11

The bath of Example 7 was used on zinc articles with the exception that the glycolic acid was replaced by a mixture of 15 ml./l. of each, chloroacetic acid and glycocoll. The pH value of the bath amounted to 1.5. The chromium coatings obtained were of comparable color and quality.

EXAMPLE 12

As in Example 1 a bath was prepared having a pH value of 1.6 and containing 31 g./l. of sodium nitrate, 37.5 g./l. of sodium dichromate, 20 g./l. of formic acid, 20 g./l. of chloroformic acid, 30 ml./l. of glacial acetic acid and the wetting agent. Zinc plated articles were immersed in the bath at 25°C. for 15 seconds. The chromium coatings obtained were well adhering and of dark olive-green color.

What is claimed is:

1. In a process of chromatizing zinc articles and zinc electroplated articles, the step which comprises immersing said articles for a period of less than 60 seconds in an aqueous chromatizing bath containing a. 12.5 g./l. to 37.5 g./l. of sodium dichromate and 12.5 g./l. to 37.5 g./l. of sodium nitrate, said solution being adjusted to a pH of 0.3 by the addition of nitric acid;

b. 25 g./l. to 70 g./l. of formic acid or chloroformic acid or both;

c. 5 ml./l. to 35 ml./l. of a member of the class consisting of glacial acetic acid, concentrated acetic acid, glycolic acid, glycocoll, chloroacetic acid and trifluoroacetic acid and, optionally d. 5 ml./l. to 12 ml./l. of formaldehyde, calculated on 100% formaldehyde the pH-value of said bath being maintained at a pH between 1.4 and 2.7.

2. An electroless chromiumplating bath comprising an aqueous solution containing besides a known wetting agent a. an aqueous solution of 12.5 g./l. to 37.5 g./l. of sodium dichromate and 12.5 g./l. to 37.5 g./l. of sodium nitrate, said solution being adjusted to a pH of 0.3 by the addition of nitric acid, b. 25 g./l. to 70 g./l. of formic acid or chloroformic acid or both;

c. 5 ml./l. to 35 ml./l. of a member of the class consisting of glacial acetic acid, concentrated acetic acid, glycolic acid, glycocoll, chloroacetic acid and trifluoroacetic acid and, optionally, d. 5 ml./l. to 12 ml./l. of formaldehyde, calculated on 100% formaldehyde said bath having a pH between 1.4 and 2.7.

* * * * *